US005449311A

United States Patent [19]

Williams

[11] Patent Number: 5,449,311

[45] **Date of Patent: * Sep. 12, 1995**

[54] STEERING SYSTEM FOR TOY VEHICLE

[76] Inventor: Larry C. Williams, 26259 Oakcrest, Southfield, Mich. 48076

[ * ] Notice: The portion of the term of this patent subsequent to May 17, 2011 has been disclaimed.

[21] Appl. No.: 209,211

[22] Filed: Mar. 10, 1994

Related U.S. Application Data

[63] Continuation-in-part of Ser. No. 858,843, Mar. 27, 1992, Pat. No. 5,312,288.

[51] Int. Cl.[6] ..... A63H 17/36

[52] U.S. Cl. ..... 446/468; 446/466

[58] Field of Search ..... 446/468, 460, 466, 470, 446/454, 451, 465

[56] References Cited

U.S. PATENT DOCUMENTS

| | | | |
|---|---|---|---|
| 1,730,296 | 10/1929 | Richter | 446/468 |
| 2,386,745 | 10/1945 | Yarbrough | 446/468 |
| 2,642,700 | 6/1953 | Zimmer | 446/468 |
| 2,946,153 | 7/1960 | Ernst . | |
| 3,144,731 | 8/1964 | Jones et al. | 446/466 |
| 3,406,480 | 10/1968 | Joffe | 446/468 |
| 3,474,564 | 10/1969 | Perryman . | |
| 3,581,435 | 6/1971 | Wingrove | 446/468 X |
| 3,635,304 | 1/1972 | Hills | 446/468 X |
| 3,696,554 | 10/1972 | Dorn | 446/468 |
| 4,595,380 | 6/1986 | Magers | 446/451 |
| 5,312,288 | 5/1994 | Williams | 446/468 |

FOREIGN PATENT DOCUMENTS

| | | | |
|---|---|---|---|
| 693323 | 8/1964 | Canada | 446/468 |
| 861526 | 1/1953 | Germany | 446/468 |
| 2713578 | 10/1978 | Germany | 446/468 |
| 892176 | 3/1962 | United Kingdom | 446/468 |

*Primary Examiner*—Mickey Yu

[57] ABSTRACT

An improved steering mechanism for toy vehicles is disclosed wherein an operator merely pushes downwardly on one lateral side of the vehicle, and the vehicle is caused to turn to that side. The invention incorporates a simplified steering system, wherein an elongate member rotates with the vehicle cab, or at least a section of the vehicle cab, and causes the front wheels to move to a location such that the vehicle will turn in the desired direction.

4 Claims, 5 Drawing Sheets

STEERING SYSTEM FOR TOY VEHICLE

This application is a continuation-in-part of U.S. application Ser. No. 07/858,843 entitled "STEERING SYSTEM FOR TOY VEHICLE" filed on Mar. 27, 1992 now U.S. Pat. No. 5,312,288.

BACKGROUND OF THE INVENTION

This application relates in general to a toy vehicle which may be easily steered.

In the prior art, toy vehicles are often not steerable. Prior art toy vehicles that are steerable are cumbersome and difficult to use. Often, relatively complex manipulation is required to steer the vehicle. A child typically uses toy vehicles and it would be desirable that the toy vehicle be easy to steer. Further, the vehicles may often not easily turn when being pushed at a relatively high rate of speed. A young child will often support himself by the vehicle, bending over the top of the vehicle, while pushing the vehicle along a path. When positioned over the vehicle, it is extremely difficult for the child to steer the vehicle.

Thus, it is an object of the present invention to disclose a vehicle which may be easily steered by a child. Further, it is an object of the present invention to disclose a toy vehicle which turns easily when being pushed at a relatively high rate of speed.

It is a further object of the invention to provide a vehicle which is steerable by tilting the vehicle, or by tilting a portion of the vehicle, wherein the steering is realistic and the vehicle is biased to return to an untilted position.

SUMMARY OF THE INVENTION

In a disclosed embodiment of the present invention, an elongate member is fixed to rotate with a vehicle cab. The vehicle cab is positioned over a vehicle base, and wheels are mounted to the base. The elongate member rotates with the vehicle cab, and is connected to a steering mechanism for the front wheels such that upon rotation of the vehicle cab, the front wheels are moved to positions that cause the vehicle to turn.

In a preferred embodiment of the present invention, the front wheels are steerable. More preferably, a lever is fixed to a side of the elongate member removed from the vehicle cab. When the vehicle cab is turned to right or left by a user, the elongate member rotates, and the lever rotates in the opposite direction to the vehicle cab. Thus, when a user of the toy vehicle pushes downwardly on the right side of the vehicle cab, the lever moves upwardly and to the left. The steering mechanism of the present invention is caused to move the front wheels such that the vehicle will turn to the right.

A user of the toy vehicle may thus easily turn the vehicle without any complicated movements. By merely applying force to the side of the vehicle cab to which the user wishes the vehicle to turn, the vehicle will be adjusted to turn to that side. More preferably, a tie-rod is connected to the lever and is connected to a flange which is fixed to pivot relative to the base and turn the wheel. The tie-rod is preferably connected to both the lever and the flange with a universal joint such that the different axes of movement of the wheel and lever are accommodated.

More preferably, a bias system returns the elongate member back to its original center position. In a most preferred embodiment of the present invention, the bias system includes a pair of coil springs attached to a plate fixed between the elongate member and the vehicle cab. When the vehicle cab is forced downwardly to the right or left, it compresses one of the two coil springs. Upon relaxation of this force, the coil springs move back to a relaxed length, centering the plate and consequently the elongate member. The steering mechanism thus adjusts such that the vehicle again begins moving forwardly.

Alternate bias systems may be used to return the elongate member back to its original center position. In disclosed embodiments, a pair of torsion spring assemblies or a pair of extension springs replace the coil springs. In another disclosed embodiment, a leaf spring is used. The leaf spring includes a pair of flexible flanges which extend to opposite sides of the elongate member. One of the pair of flanges of the leaf spring is flexed when the vehicle cab is forced downwardly to the right or left. Upon relaxation of this force, the flange returns to its unflexed position, centering the plate and consequently the elongate member.

The only required manipulation to turn the vehicle is the application of a downward force to one side of the vehicle cab. A user is able to apply this force easily, even when pushing the vehicle at a relatively high rate of speed. The bias system automatically returns the vehicle cab to an untilted position once the downward force is removed.

In an second embodiment of the invention, the vehicle cab has a forward section and a rearward section. The forward section of the vehicle cab is secured to the vehicle base for movement with the vehicle base. The rearward section is secured to the elongate member for movement with the elongate member. The elongate member rotates by tilting of the rearward section only. As in the first embodiment, such tilting results in actuation of the steering mechanism. A bias system returns the rearward section of the vehicle cab to a neutral, untilted position upon relaxation of a downward tilting force.

In a third embodiment of the invention, the forward and rearward sections of the vehicle cab are reversed structurally from the second embodiment. The rearward section is secured to the vehicle base for movement with the vehicle base, and the forward section of the vehicle cab is secured to the elongate member. The steering mechanism is actuated by tilting of the forward section only.

In a fourth embodiment of the invention, a vehicle cab includes a forward section, a rearward section and a middle section. The forward section and the rearward section of the vehicle cab are secured to the vehicle base for movement with the vehicle base. The middle section of the vehicle cab is secured to the elongate member for movement with the elongate member. The elongate member rotates by tilting the middle section only. As in the first embodiment, such tilting results in activation of the steering mechanism. A bias system returns the middle section to a neutral, untilted position upon removal of a downward force. In variations of this embodiment, the middle section may be a roll bar, or a figure depicting a driver of the vehicle.

These and other features of the present invention will be best understood from the following specification and drawings, of which the following is a brief description.

DETAILED DESCRIPTION OF A PREFERRED EMBODIMENT

Figure 1:
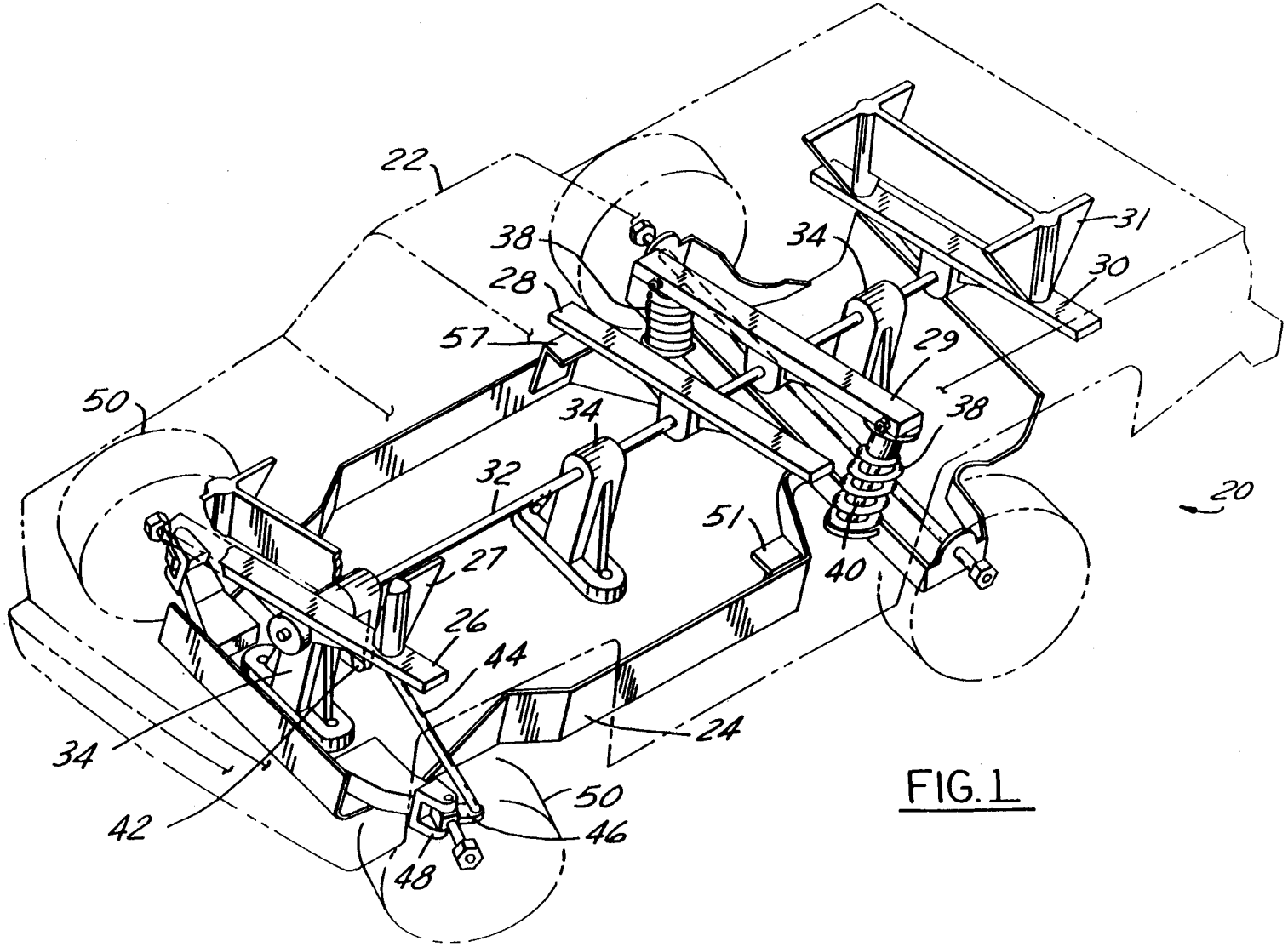
FIG. 1 is a perspective view of a toy vehicle incorporating the present invention.

A toy vehicle 20 is shown in FIG. 1 having a vehicle cab 22, shown in phantom, mounted above a base 24. In one preferred embodiment, vehicle cab 22 is not directly fastened to base 24, but may pivot about a central longitudinal axis of base 24. To this end, plate 26 is fixed by bosses 27 to an under face of vehicle cab 22. Similarly, plates 28 and 29 are fixed to an underside of vehicle cab 22 and a rear plate 30 is also fixed by boss 31 to an under face of vehicle cab 22.

An elongate rod 32 is fixed to rotate with plates 26, 28, 29 and 30, and consequently with vehicle cab 22. Rod 32 is mounted in bearings 34 at spaced locations along base 24. A pair of centering bias coil springs 38 are mounted on rods 40, and bias plate 29 towards a centered position.

A lever 42 rotates with rod 32, and is fixed to tie-rods 44 which in turn are fixed to flanges 46. Flanges 46 pivot within bracket 48 to turn wheels 50. A similar arrangement is used for both front wheels 50.

When a user of toy vehicle 20 pushes downwardly on the right side of vehicle cab 22, rod 32 rotates counterclockwise as viewed from the front of vehicle 20. Lever 42 would also rotate counter clockwise. This causes the left tie rod 44 to be forced upwardly and outwardly, causing flange 46 associated with the left wheel 50 to be pivot outwardly, causing the left wheel 50 to also pivot outwardly. At the same time, a similar tie-rod 44 and flange 46 causes the right front wheel 50 to pivot inwardly to the position shown in this figure. In this location, front wheels 50 would cause toy vehicle 20 to turn to the right. As shown, the right coil spring 38 is compressed. Stop 51 limit the movement of plates 28.

Thus, a user of toy vehicle 20 merely pushes downwardly on one side of the vehicle to cause the vehicle to turn. The vehicle will then adjust and turn to that side. Once this downward force is removed, the compressed coil spring 38 extends to its relaxed length, and plate 29 is centered. As this occurs, the other plates 26, 28 and 30, and rod 32 will be returned to their centered position. This brings tie-rods 44 back to a centered position, and returns wheels 50 to a straight forward position.

Figure 2:
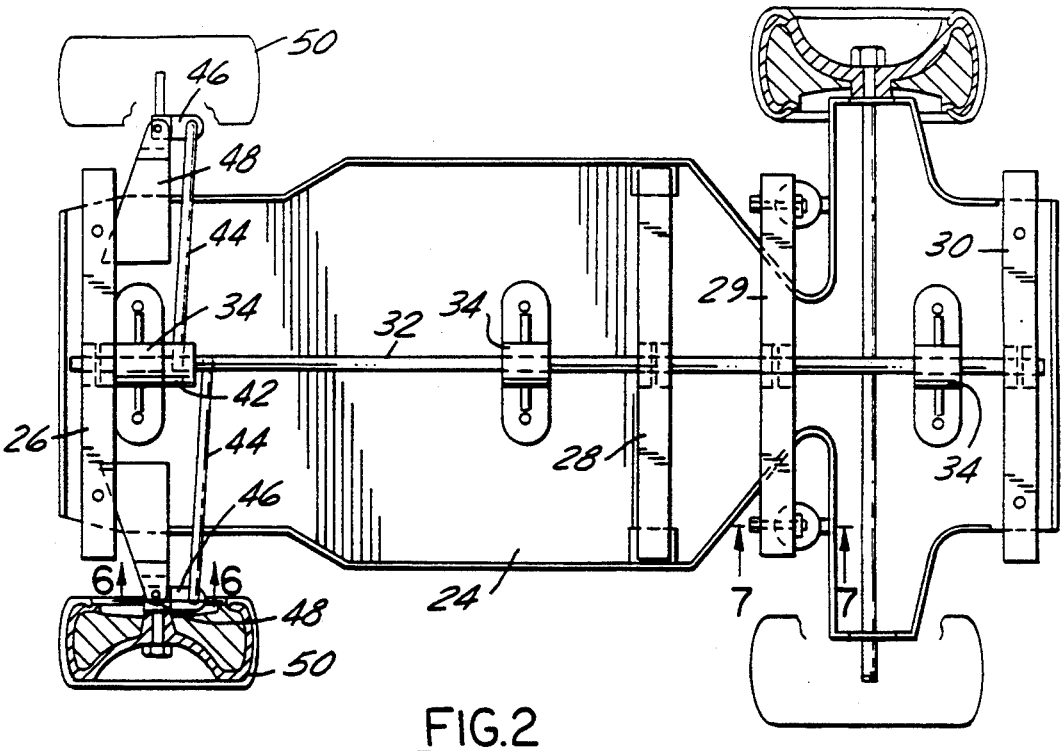
FIG. 2 is a top view of a portion of the vehicle shown in FIG. 1.

As shown in FIG. 2, one tie-rod 44 is mounted on a forward face of lever 42, while a second rod 44 is mounted on a rearward face. Further, the bearings 34 are mounted at three spaced locations on base 24.

Figure 3:
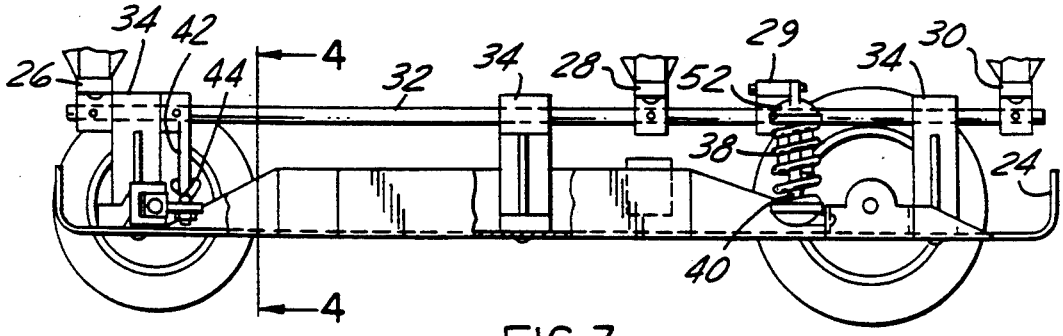
FIG. 3 is a side view of the portion shown in FIG. 2.

As shown in FIG. 3, lever 42 extends downwardly from rod 32, which is in turn spaced downwardly from the vehicle cab, not shown in this figure. Thus, lever 42 rotates in an opposed direction from the vehicle cab, when the vehicle cab is rotated to turn the vehicle. This causes the steering mechanism to adjust to the proper location to turn the vehicle in the desired direction.

As further shown in FIG. 3, spring 38 is mounted on a member 52 which moves with plate 29, and slides on rod 40. When plate 29 rotates with rod 32, one of the coil springs 38 is compressed by member 52 moving downwardly. As described above, once this force is removed, coil spring 38 will move back to its relaxed position, returning the members to centered locations.

Figure 4:
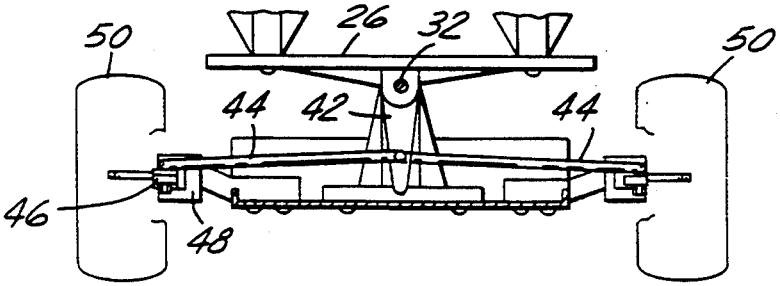
FIG. 4 is a cross-sectional view along line 4—4 as shown in FIG. 3.

As shown in FIG. 4, lever 42 extends downwardly from rod 32. Tie-rods 44 extend from each end of lever 42 to flanges 46 associated with each wheel 50.

Figure 5:
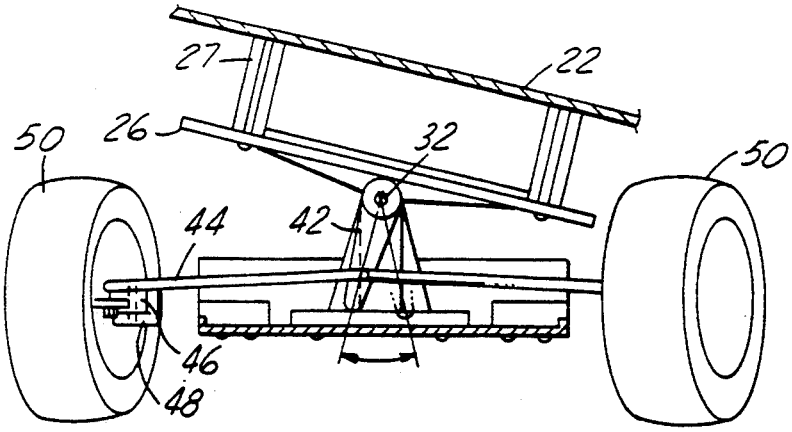
FIG. 5 is a view similar to FIG. 4, but showing turning of the vehicle.

As shown in FIG. 5, plate 26 is connected by bosses 27 to an underside of vehicle cab 22. Vehicle cab 22 is shown forced downwardly to the right in this figure. As shown, lever 42 has rotated in the opposite direction to cause the wheels to turn to the position shown in FIG. 1.

Figure 6:
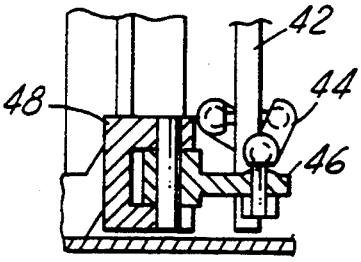
FIG. 6 is a cross-sectional view along line 6—6 as show in FIG. 2.

As shown in FIG. 6, lever 42 is connected to tie-rods 44 by ball and socket universal joints. Tie-rods 44 are connected to flanges 46 by similar ball and socket joints. Flanges 46 are pivotally received within brackets 48. The universal joints accommodate the different axes of movement between lever 42 and flange 46, allowing easy movement of wheels 50.

Figure 7:
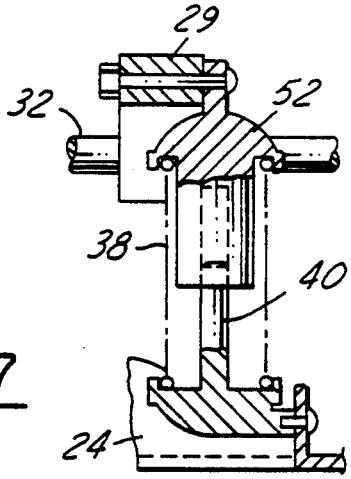
FIG. 7 is a cross-sectional view along line 7—7 as shown in FIG. 2.

As shown in FIG. 7, member 52 is slidably received on rod 40 which is fixed to base 24. Plate 29 pivots relative to member 52, since member 52 must adjust on rod 40.

The only required manipulation to turn the vehicle is the application of a downward force to one side of the vehicle cab. A user is able to apply this force easily, even when pushing the vehicle at a relatively high rate of speed. The bias system automatically returns the vehicle cab to an untilted position once the downward force is removed.

Figure 8:
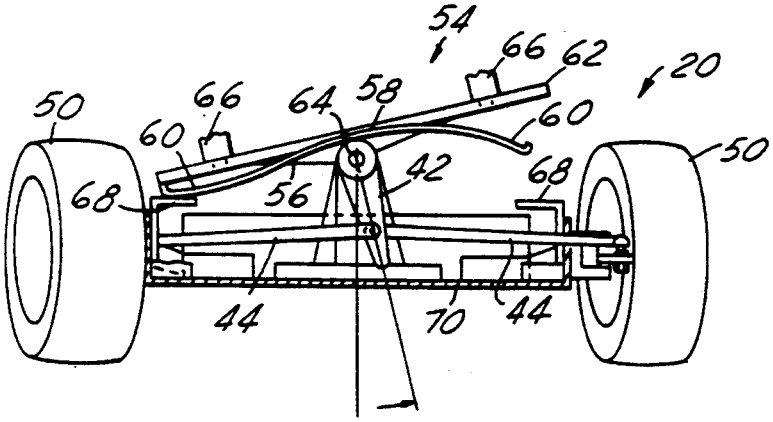
FIG. 8 is a cross-sectional view of an alternate bias system, taken through a center of the vehicle facing towards the front.

FIG. 8 illustrates an alternate bias system 54 to return the elongate member back to its original center position and consequently return the cab 22 to its neutral position. The view is taken along a center of the toy vehicle 20 facing towards the front of the vehicle. In the alternate bias system 54, the pair of centering bias coil springs 38 are replaced with a leaf spring 56. Leaf spring 56 includes a central portion 58, and a pair of flexible flanges 60. Flanges 60 are opposed, and extend outwardly from central portion 58. In a manner similar to the first embodiment, a plate 62 is fixed to an elongate rod 64. A pair of bosses 66 attach the vehicle cab 22 to plate 62. Vehicle cab 22 and the steering mechanism are similar to the first embodiment, and like reference numerals are therefore used. A pair of stops 68 are secured to a base 70, and align approximately with plate 62. A downward force to one side of the vehicle cab 22 causes one of the flanges 60 to flex against one of the stops 68. Once this downward force is removed, the leaf spring 54 returns to its relaxed position, and plate 62 and rod 64 are centered. This brings tie-rods 44 back to a centered position, and returns wheels 50 to a straight forward position.

Figure 9:
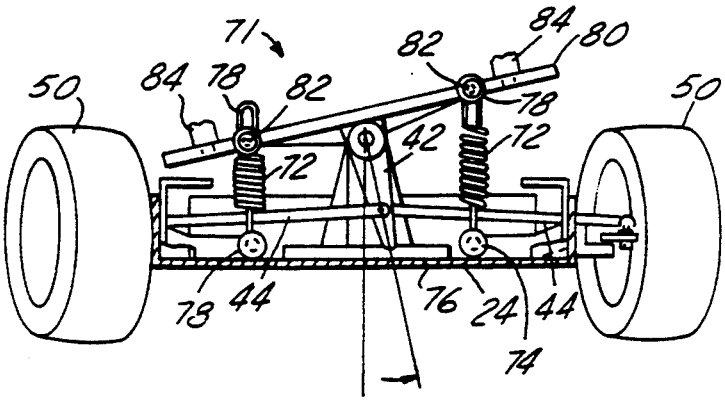
FIG. 9 is a cross-sectional view of another alternative bias system corresponding approximately to FIG. 8.

FIG. 9 illustrates another alternate bias system 71, wherein a pair of extension springs 72 replace leaf spring 54. Each extension spring 72 includes a first end 74 rigidly attached to a base 76, and a second end 78 slidingly coupled to a plate 80. Second end 78 of extension spring 72 defines a loop. Plate 80 includes a pair of projections 82, wherein one projection 82 is received in each loop, and which slides along the loop. A pair of bosses 84 attach the vehicle cab 22 to plate 80, as in the first embodiment. A downward force to one side of the vehicle cab 22 causes one of the extension springs to flex and the other extension spring to compress. Once this downward force is removed, both extension springs 72 return to their relaxed position, and plate 80 and rod 64 are centered. The loops of extension springs 72 allow for slight movement of plate 80 downwardly before compression of the spring.

Figure 10:
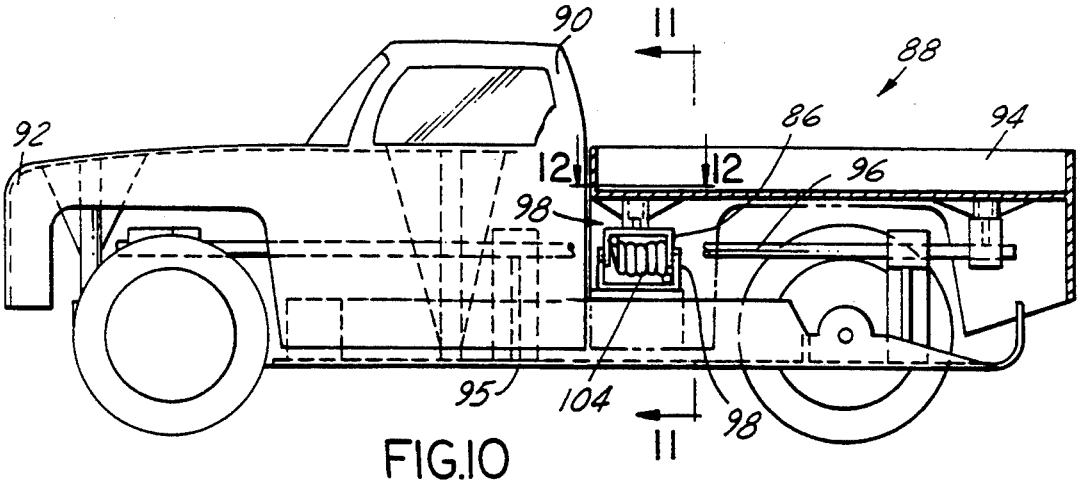
FIG. 10 is a side view of an second embodiment of a toy vehicle incorporating the present invention.
Figure 11:
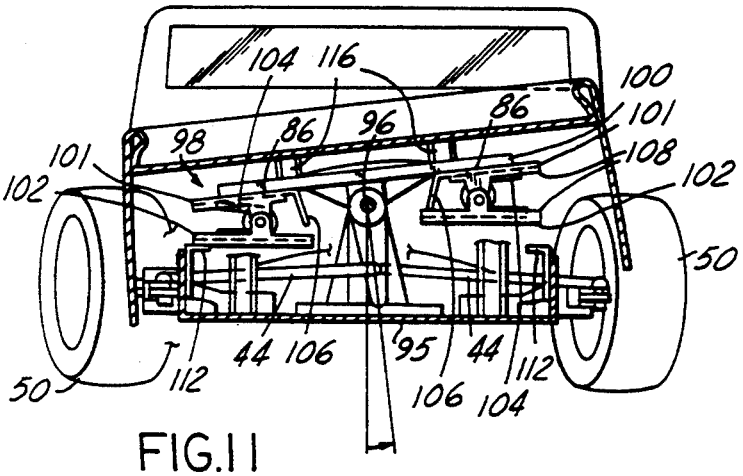
FIG. 11 is a cross-sectional view along line 11—11 as shown in FIG. 10.
Figure 12:
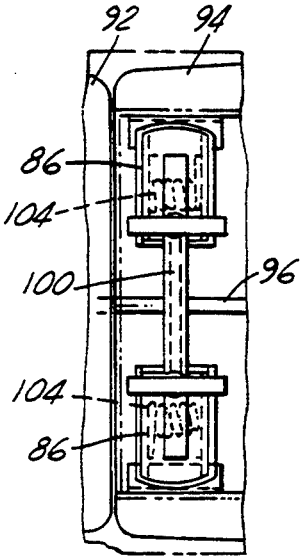
FIG. 12 is a partial top view along line 12—12 as shown in FIG. 10.

An additional bias system is illustrated in FIGS. 10–12, wherein a pair of torsion spring assemblies 86 provide the bias force, described in detail below. A variety of other bias systems may also be incorporated in the inventive toy vehicle, such as a conventional rubber band attached to each side of the plate and the vehicle base. In a manner known to those skilled in the art, the toy vehicle may be modified to incorporate a variety of other types of bias systems.

FIG. 10 illustrates a second embodiment of a toy vehicle 88, wherein a vehicle cab 90 has a forward section 92 and a rearward section 94. Forward section 92 of vehicle cab 90 is secured to a vehicle base 95 for movement with the vehicle base. Rearward section 94 is secured to an elongate member 96 for movement with the elongate member. Elongate member 96 rotates by tilting of rearward section 94 only. Such tilting results in actuation of the steering mechanism, in a manner similar to that described for the first embodiment. A bias system 98 returns rearward section 94 of vehicle cab 90 to a neutral, untilted position upon relaxation of a downward tilting force. FIG. 11 illustrates rearward section 94 in a tilted position, while forward section 92 remains in a neutral untilted position.

As shown in FIGS. 11 and 12, bias system 98 includes the pair of torsion spring assemblies 86 attached to opposing ends of a plate 100. Each torsion spring assembly 86 includes an upper member 101, a lower member 102 and a spring 104. Upper member 101 is hinged to lower member 102, and includes a flange 106 limiting the extent of movement relative to lower member 102. Outer ends 108 of upper and lower members are biased by spring 104, and urged away from each other. A stop 112 is secured to each side of vehicle base 95, and aligns approximately with an end of plate 100. In a manner similar to the first embodiment, plate 100 is fixed to elongate rod 96. A pair of bosses 116 attach rearward section 94 of vehicle cab 90 to plate 100. The steering mechanism is similar to the first embodiment, and like reference numerals are therefore used. A downward force to one side of rearward section 94 causes lower member 102 of one of the torsion spring assemblies 86 to flex against one of the stops 112. Once this downward force is removed, the torsion spring assembly 86 returns to its relaxed position, and plate 100 and rod 96 are centered. This brings tie-rods 44 back to a centered position, and returns wheels 50 to a straight forward position.

Figure 13:
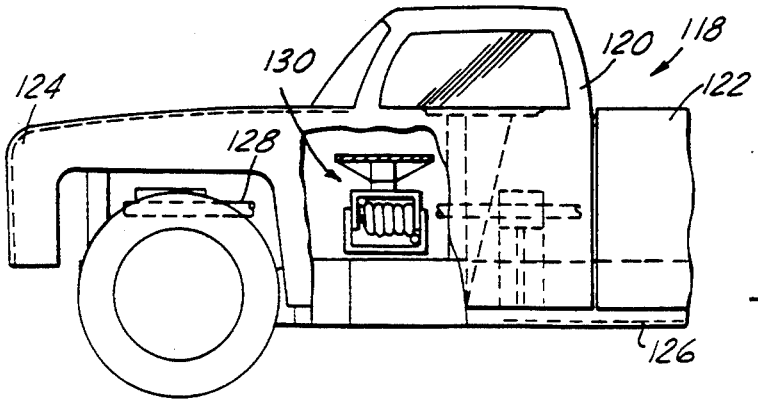
FIG. 13 is a partial side view of a third embodiment of a toy vehicle incorporating the present invention.

A third embodiment of a toy vehicle 118 is shown in FIG. 13, wherein the rearward section and forward section of the vehicle cab are structurally reversed from the second embodiment. Toy vehicle 118 includes a vehicle cab 120 having a rearward section 122 and a forward section 124. Rearward section 122 of vehicle cab 120 is secured to a vehicle base 126 for movement with the vehicle base. Forward section 124 is secured to an elongate member 128 for movement with the elongate member. Elongate member 128 rotates by tilting of forward section 124 only. Such tilting results in actuation of the steering mechanism, in a manner similar to that described for the first embodiment. A bias system 130 returns forward section 124 of vehicle cab 120 to a neutral, untilted position upon relaxation of a downward tilting force.

Figure 14:
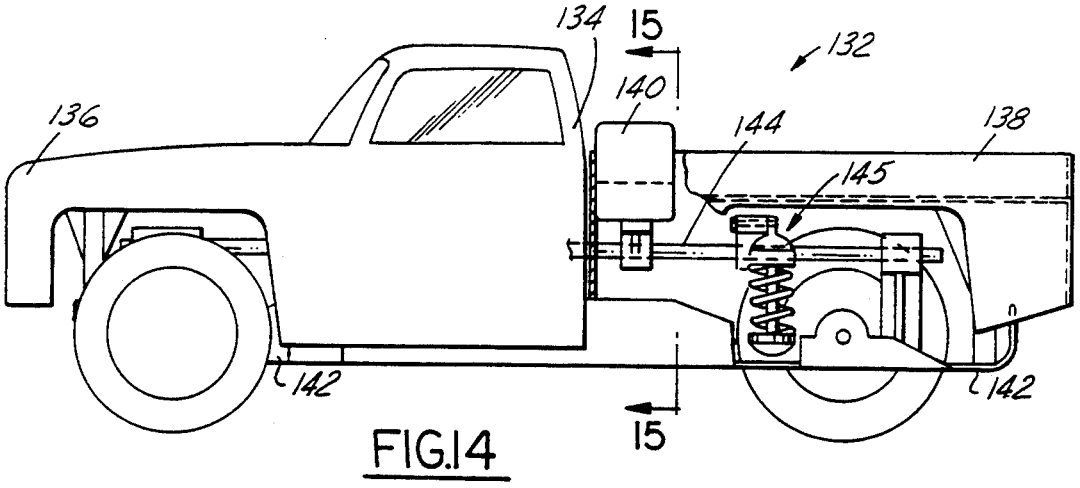
FIG. 14 is a side view of a fourth embodiment of a toy vehicle incorporating the present invention.

A fourth embodiment of a toy vehicle 132 is shown in FIG. 14, wherein a vehicle cab 134 includes a forward section 136, a rearward section 138 and a middle section 140. Forward section 136 and rearward section 138 of the vehicle cab 134 are secured to a vehicle base 142 for movement with the vehicle base. The middle section 140 of vehicle cab 134 is secured to an elongate member 144 for movement with the elongate member.

Figure 15:
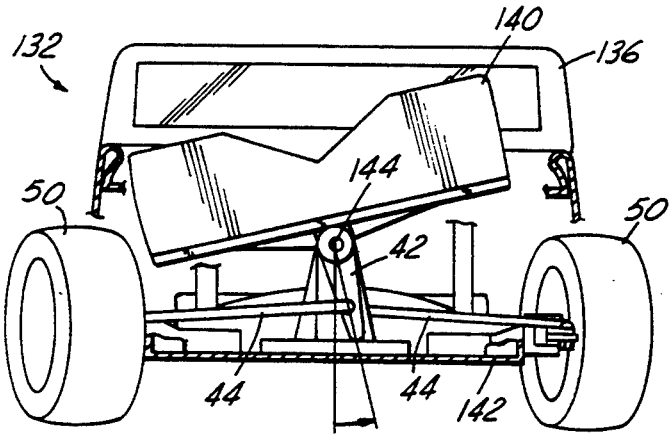
FIG. 15 is a cross-sectional view along lines 15—15 as shown in FIG. 14.

As shown in FIG. 15, elongate member 144 rotates by tilting middle section 140 only. A bias system 145 returns middle section 140 to a neutral, untilted position upon removal of a downward force, as described for the first embodiment.

Figure 16:
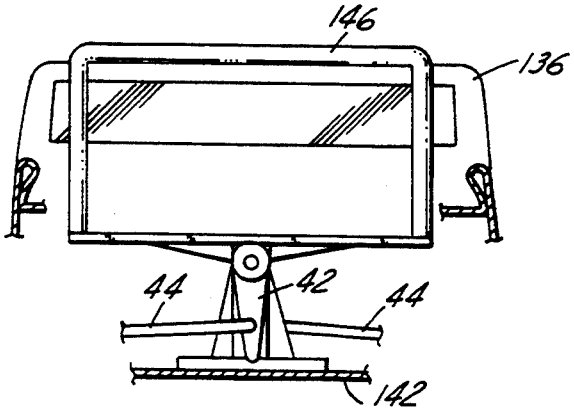
FIG. 16 is a partial cross-sectional view of an alternative embodiment of a toy vehicle corresponding approximately to FIG. 15.

FIG. 16 shows a variation of the fourth embodiment, wherein the middle section is a roll bar 146. Although shown in the untilted position, roll bar 146 is secured to elongate member 144 for rotation of elongate member 144. Actuation of the steering mechanism is achieved by tilting roll bar 146.

Figure 17:
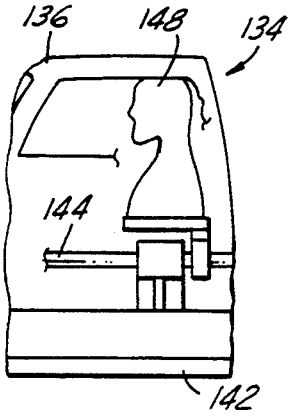
FIG. 17 is a partial side view of an alternative embodiment of a toy vehicle according to the present invention.

FIG. 17 shows another variation of the fourth embodiment, wherein the middle section is a figure depicting a driver 148 of the vehicle. Driver 148 is secured to elongate member 144 for rotation with the elongate member. Actuation of the steering mechanism is achieved by tilting driver 148, while the other portions of vehicle cab 134 remain level.

Preferred embodiments of the present invention have been disclosed, however, one of ordinary skill in the art would recognize that certain modifications would come within the scope of this invention. For that reason the following claims should be studied in order to determine the true scope and content of this invention.

I claim:

1. A toy vehicle comprising:

an elongated base supporting a pair of wheels at a front longitudinal position, and at least one wheel at a rear longitudinal position, said wheels at said front longitudinal position being steerable;

a plurality of support bearings spaced longitudinally along and mounted to said elongated base, each of said support bearings having an upwardly positioned portion with an aperture;

an elongated shaft member, said elongated shaft member extending along a longitudinal axis through said support bearing apertures and being rotatably mounted thereto, said elongated shaft member being free to rotate about said longitudinal axis through at least a limited rotational extent;

a lever attached to said elongated shaft member at said front longitudinal position such that said lever and said elongated shaft member rotate together;

a steering mechanism for each of said wheels at said front longitudinal position, said steering mechanism being connected to said lever;

a plurality of plates spaced along said longitudinal axis, each of said plates having a downwardly positioned portion with an aperture that is aligned with said support bearing apertures, and through which said elongated shaft member extends and is mounted thereon such that said plurality of plates and said elongated shaft member rotate together relative to said elongated base;

a bias member disposed between said elongated base and one of said plates whereby said bias member exerts a biasing force against said one plate which biases said elongated shaft member to bias said lever toward a neutral position vertically downwardly from said elongated shaft member such that said wheels at said front longitudinal position are centered to cause the vehicle to move in a straight path; and a cab positioned above said elongated base, said cab being connected to said plurality of plates, said cab being positioned vertically above said elongated shaft member when said lever is in said neutral position such that when said cab is rotated downwardly to the right of said longitudinal axis, said lever rotates upwardly and to the left of said longitudinal axis such that said wheels at said front longitudinal position are moved to cause the vehicle to turn in a corresponding direction, and said cab, when rotated downwardly to the left of said longitudinal axis, said lever rotates upwardly to the right of said longitudinal axis such that said wheels at said front longitudinal position are moved to cause the vehicle to turn in an opposite direction.

2. The vehicle as recited in claim 1, wherein said bias member is an extension spring.

3. The vehicle as recited in claim 1, wherein said bias member is a torsion spring.

4. The vehicle as recited in claim 1, wherein said bias member is a leaf spring having a central portion and a pair of flexible flanges extending from opposing ends of said central portion, each of said flexible flanges being disposed between one of said plates and said base.

* * * * *